US005392099A

United States Patent [19]

Kusumoto et al.

[11] Patent Number: 5,392,099

[45] Date of Patent: Feb. 21, 1995

[54] IMAGE FORMING APPARATUS HAVING CLEANING MEMBER FOR CLEANING CHARGING WIRE

[75] Inventors: Hiroshi Kusumoto; Daisuke Hayashi; Hideki Ishida; Shoichi Kitagawa; Mitsugu Miyamoto, all of Osaka, Japan

[73] Assignee: Mita Industrial Co., Ltd., Osaka, Japan

[21] Appl. No.: 124,145

[22] Filed: Sep. 20, 1993

[30] Foreign Application Priority Data

Sep. 25, 1992 [JP] Japan ..... 4-256738

[51] Int. Cl.[6] ..... G03G 15/00

[52] U.S. Cl. ..... 355/221; 250/325; 355/207; 355/215

[58] Field of Search ..... 355/205, 207, 208, 221, 355/264, 274, 215; 250/324–326; 361/229, 230

[56] References Cited

U.S. PATENT DOCUMENTS

| | | | |
|---|---|---|---|
| 3,842,273 | 10/1974 | Van Buskirk | 355/221 X |
| 3,965,400 | 6/1976 | Tolliver | 355/221 X |
| 4,864,363 | 9/1989 | Shinada | 355/221 |
| 4,885,466 | 12/1989 | Koichi et al. | 250/324 |
| 4,924,268 | 5/1990 | Ogura | 355/219 |
| 5,012,093 | 4/1991 | Shimizu | 250/324 |
| 5,023,748 | 6/1991 | Okamoto et al. | 361/229 |
| 5,170,314 | 12/1992 | Saito | 361/212 |
| 5,182,694 | 1/1993 | Endo | 361/229 |
| 5,194,897 | 3/1993 | Yoshiyama et al. | 355/215 |
| 5,223,896 | 6/1993 | Shimizu et al. | 355/208 |
| 5,250,991 | 10/1993 | Ikeda | 355/215 |

FOREIGN PATENT DOCUMENTS 0179659 7/1990 Japan .

*Primary Examiner*—Robert B. Beatty
*Attorney, Agent, or Firm*—Jordan and Hamburg

[57] ABSTRACT

An image forming apparatus includes a charger for charging a photosensitive drum, the charger having a charging wire extending in a lengthwise direction of the photosensitive drum, an optical system for illuminating a document and introducing a reflected light to the photosensitive drum to produce a latent image of the document, a detector for detecting a target portion of the charging wire causing a white line based on a copied image on copy paper, a cleaning member movable along the charging wire and adapted for cleaning the charging wire, a driver for moving the cleaning member along the charging wire, and a controller responsive to the detector for controlling the driver to move the cleaning member to the target portion of the charging wire and clean the target portion.

12 Claims, 8 Drawing Sheets

IMAGE FORMING APPARATUS HAVING CLEANING MEMBER FOR CLEANING CHARGING WIRE

BACKGROUND OF THE INVENTION

The present invention relates to an image forming apparatus which detects a stained portion of a charging wire by detecting an undesirably made white line (hereinafter merely referred to as a white line) in a formed image and cleans the charging wire at the stained portion.

Generally, image forming apparatuses such as a copying machine experience undesirable adhesion of particles to a charging wire. These particles include flying toner which is toner which is residual on the surface of a photosensitive drum after an image transfer operation and is not cleaned by a cleaning device, dust entered into the image forming apparatus, and paper powders coming off from copying sheets. In this case, a charger cannot apply a voltage of a specified level to the photosensitive drum and a white line appears in a formed image over a sub-scanning direction thereof. Conventionally, when this occurs, the charger is removed from the image forming apparatus and is cleaned carefully at a portion corresponding to the white line found on the copy sheet. Such a work has been very cumbersome. Accordingly, there has been recently proposed an image forming apparatus provided with a charging wire cleaning mechanism. Specifically, a cleaning pad is provided in a charger to clean a charging wire. This cleaning pad slides along the charging wire to clean the stains such as toner and paper powders adhered to the charging wire.

In the image forming apparatus provided with the charging wire cleaning mechanism, the charging wire is cleaned during a period which lasts until the apparatus brought into a steady state after the apparatus is started by turning on a main switch (a period which lasts until an image forming operation is permitted after the start-up of the apparatus). The arrangement is such that the cleaning pad makes one back-and-forth sliding movement along the charging wire in a main scanning direction at a constant speed while being held in contact with the charging wire. However, this is not sufficient sometimes to clean off the stains such as the adhered toner completely. In order to overcome this problem, the cleaning pad may be arranged to move back and forth along the charging wire plurality of times. This inadvertently causes an in a cleaning time or faster abrasion of the cleaning pad, and thus may not be an efficient way.

SUMMARY OF THE INVENTION

It is an object of the invention to provide an image forming apparatus which has overcome the foregoing problems, and can clean a charging wire more efficiently.

Accordingly, an image forming apparatus comprises a photosensitive body; charger means for charging the photosensitive body; the charger means including a charging wire extending in a lengthwise direction of the photosensitive body; an optical system for illuminating a document and introducing a reflected light to the photosensitive body to produce a latent image of the document; developing means for developing the latent image to a toner image; transferring means for transferring the toner image onto copy paper; detector means for detecting a target portion of the charging wire causing a white line based on a copied image on copy paper; a cleaning member movable along the charging wire and adapted for cleaning the charging wire; driver means for moving the cleaning member along the charging wire; and cleaning member controller means responsive to the detector means for controlling the driver means to move the cleaning member to the target portion of the charging wire and clean the target portion.

With thus constructed image forming apparatus, a target portion of the charging wire causing a white line is detected by the detector means. The cleaning member is moved to the target portion detected by the detector means. Accordingly, the charging wire can be cleaned assuredly and efficiently.

It may be appropriate to move the cleaning member back-and-forth within a specified range including the target portion. With this construction, the target portion is concentratedly cleaned, thus increasing the cleaning efficiency.

Also, it may be appropriate to move the cleaning member at a decreased speed within a specified range including the target portion. With this construction, the cleaning member is moved at a slower speed over the target portion, which consequently increases the frictional resistance between the charging wire and the cleaning member. Accordingly, the target portion can be cleaned more efficiently.

Further, it may be appropriate to further provide a document placing portion on which a document is to be placed, and provide a reference document member on an appropriate position of the portion outside the document placing portion, the reference document member being scanned by the optical system when detecting the target portion.

With this construction, when a target portion is detected, the scanning of the optical system is executed to the reference document member provided on the image forming apparatus. Accordingly, the operation can be eliminated of specially placing a reference document on the image forming apparatus when checking a white line, thus enabling the cleaning of charging wire to be automated and increasing the cleaning efficiency.

Further, it may be appropriate to further provide copy paper refeeding means for temporarily storing copy paper carrying a copied image on one side thereof and refeeding the copy paper to the photosensitive body to copy another image on the other side, and provide a sensor for detecting a white line on a copied image on the copy paper refeeding means.

With thus constructed image forming apparatus, when the charging wire is cleaned, copy paper is temporarily stored and refed to the photosensitive body by the refeeding means to copy a reference document image on the reverse side of the copy paper, and is again stored to execute the white line detection. Accordingly, copy paper can be usefully used for white line detection.

Further, it may be appropriate to store copy paper carrying a copied image on one side thereof to execute a first white line detection, and convey the copy paper to the photosensitive body after cleaning the target portion, if any, and to again store the copy paper carrying another copied image on the other side thereof to execute a second white line detection.

With this construction, the white line detection is executed again after cleaning of the charging wire to check the cleaning result. This can improve the cleaning performance.

Furthermore, it may be appropriate to provide sensor driving means for driving the sensor, memory means for storing the target portion detected by the first white line detection, and sensor driving controller means for controlling the sensor driving means to position the sensor on the target portion stored in the memory means in the second white line detection.

With this construction, the second white line detection is executed for the target portion detected by the first detection. Accordingly, the cleaning efficiency can be remarkably increased.

The above and other objects, features and advantages of the present invention will become more apparent upon a reading of the following detailed description and drawings.

DETAILED DESCRIPTION OF THE PREFERRED EMBODIMENTS OF THE INVENTION

Figure 1:
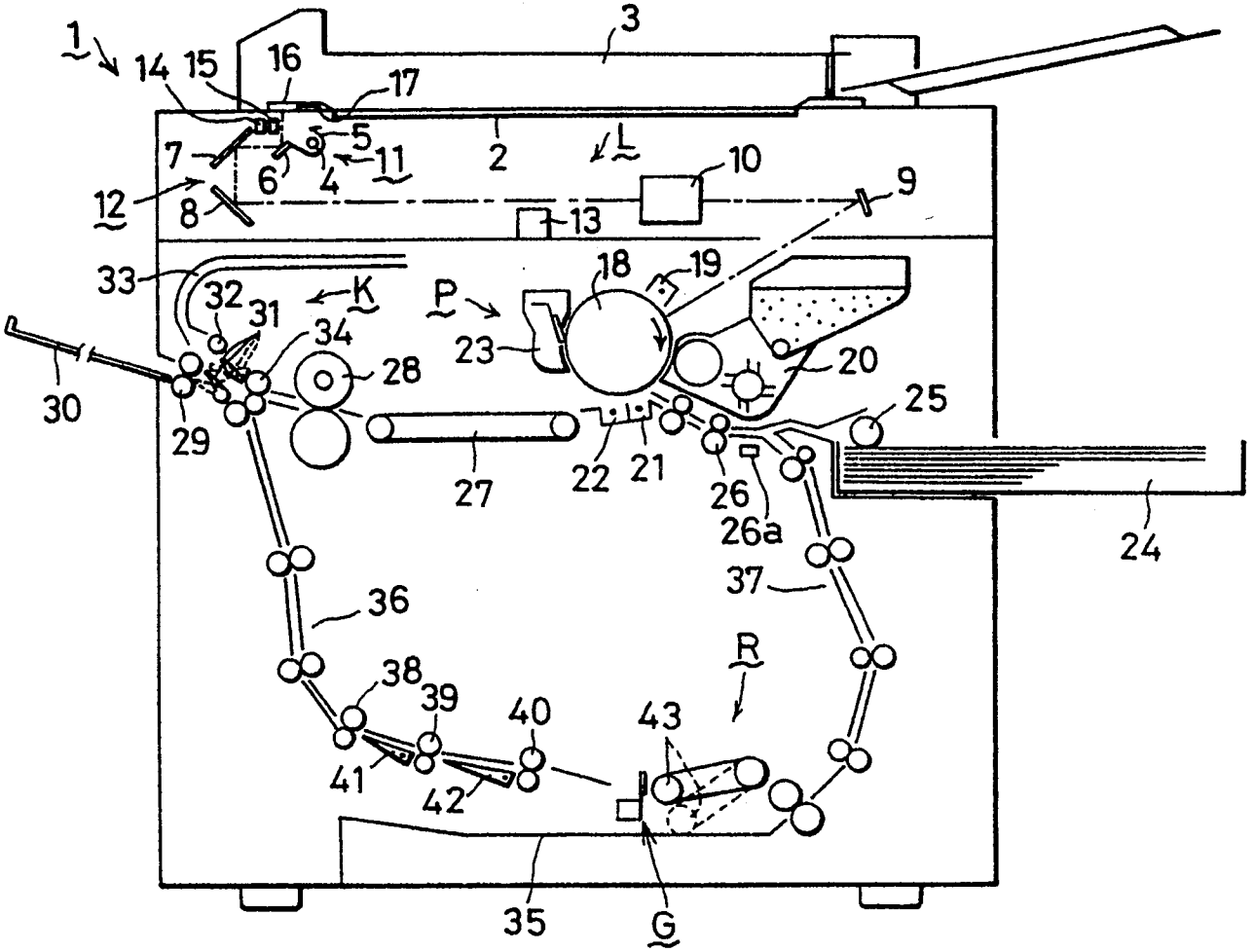
FIG. 1 is a schematic diagram showing an overall construction of an image forming apparatus according to the invention.

An image forming apparatus (copying machine) according to the invention will be described with reference to the accompanying drawings. FIG. 1 is a schematic diagram showing an overall construction of an exemplary copying machine according to the invention.

In this figure, a copying machine 1 includes a transparent document platen 2 and an automatic document feeder 3 in an upper portion thereof, and an optical assembly L, an imaging assembly P, a sheet inverting device K, a refeeding assembly R, and a sheet transport assembly in the interior thereof. The automatic document feeder 3 feeds documents to be copied to the document platen 2 and discharges the same. The sheet transport assembly feeds and transports copy sheets.

The optical assembly L includes a halogen lamp 4, a first optical system 11 including reflecting mirrors 5, 6, a second optical system 12 including reflecting mirrors 7, 8, a reflecting mirror 9 and an imaging lens 10. A drive motor 13 is provided substantially at the center of the optical assembly L. This motor 13 is driven to move the first and second optical systems 11, 12 reciprocally within a desired range so that a document image is projected onto the imaging assembly P. Specifically, these optical systems 11, 12 are made reciprocally movable along a lower surface of the document platen 2 serving as a sub-scanning range for a document and additional ranges on opposite sides of the sub-scanning range. The transverse distance of the addition range may be defined between a left end of the document platen and a home position switch 14. While the optical systems 11, 12 move in the additional ranges, a scanning speed thereof and a light amount of a lamp are stabilized. The home position switch 14 is designed to detect that the first optical system 11 is in an initial position, and a timing switch 15 is provided for a reference for reciprocal movement. With these switches, it is detected that the optical systems are set in the initial positions and an operational reference of each assembly in the copying machine 1 is designated.

A reference document member 17 is placed between the reference position of the reciprocal movement indicated by the timing switch 15 and the left end of the document platen 2 and below an indicating plate 16 for indicating a leading edge of a document placeable region. A gray document is used as the reference document member 17 because it satisfies the following two conditions: 1) a white line is detectable in a copied image, and 2) an amount of toner to be used is relatively small. The reference document member 17 is placed in line with the document platen 2 so as to maintain detection accuracy.

The imaging assembly P includes a photosensitive drum as well as a charger 19, a developing device 20, a transfer device 21, a separating device 22, and a cleaning device 23 arranged in this order from an upstream side around the drum 18. Upon the receipt of the document image projected from the optical assembly L, an electrostatic latent image is formed on the surface of the drum 18. The charger 19 charges the surface of the drum 18 at a specified potential and includes a cleaning mechanism for cleaning a charging wire thereof. The developing device 20 develops the latent image into a toner image. The transfer device 21 transfers the toner image on the drum 18 to a copy sheet. The separating device 22 separates the copy sheet bearing the toner image from the surface of the drum 18. The cleaning device 23 removes toner residual on the surface of the drum 18.

The sheet transport assembly includes a cassette 24, a feed roller 25, and a pair of registration rollers 26 from an upstream side along a direction of transport of a copy sheet. Further, a registration switch **26*a* is disposed immediately upstream from the registration rollers 26. Upon the lapse of a predetermined period after the copy sheet passes over the switch 26*a* to turn the same on, the driving of the rollers 26 is stopped. Then, the rollers 26 are driven again in synchronism with the reciprocal movement of the optical systems and the copy sheet is fed to the photosensitive drum 18. The sheet transport assembly also includes a transport belt 27, a fixing device 28, a pair of discharge rollers 29, a discharge tray 30**, and the like so as to transport further the copy sheet separated from the drum surface.

The sheet inverting device K is arranged between the fixing device 28 and the pair of discharge rollers 29 and includes a path switching member 31, a reverse roller 32, and an inverting path 33. The path switching member 31 is movable between positions indicated by solid and broken lines in FIG. 1. When the member 31 is at the position indicated by broken line, the copy sheet from the transport rollers 34 is guided linearly to the discharge rollers 29. On the other hand, when the member 31 is at the position indicated by solid line, the copy sheet from the transport rollers 34 is guided into the inverting path 33 to have a transport direction thereof inverted and is then fed to the refeeding assembly R. The reverse roller 32 is shiftable to a position in contact with the upper located discharge roller 29 when the copy sheet is fed to the refeeding assembly R.

The refeeding assembly R constitutes a return path extending from the sheet inverting device K to the sheet feeding path downstream from the cassette 24. The refeeding assembly R includes an intermediate tray 35 for containing the copy sheet temporarily, a first path 36 for transporting the copy sheet to the intermediate tray 35, and a second path 37 for refeeding the copy sheet from the intermediate tray 35 to the imaging assembly P. The refeeding assembly R further includes transport rollers 38, 39, 40 constituting the first path 36, transport path switching claws 41, 42, a feed roller 43, and a white line detector G to be described later. The switching claws 41, 42 are disposed respectively between the rollers 38 and 39 and between the rollers 39 and 40 so as to switch a transport distance to the intermediate tray 35 according to the size of the copy sheet. The feed roller 43 is disposed at a downstream end of the intermediate tray 35 to feed the copy sheet contained therein.

In the copying machine 1 thus constructed, the light from the halogen lamp 4 is reflected by a document surface and the reflected light representing the document image is introduced to the photosensitive drum 18 through the reflecting mirrors 6, 7, 8, the imaging lens 10, and the reflecting mirror 9. While rotating in a direction indicated by an arrow in FIG. 1, the drum 18 is charged at a specified potential by the charger 19. The charged surface of the drum 18 is exposed to the light representing the document image and thereby an electrostatic latent image is formed. The latent image on the surface of the drum 18 is developed by the developing device 20 into a toner image, which is then transferred to a copy sheet fed from the cassette 24 by the transfer device 21. The copy sheet bearing the toner image is separated from the drum surface by the separating device 22 and is discharged onto the discharge tray 30 through the transport belt 27, the fixing device 28, and the discharge rollers 29. On the other hand, when a duplex copy is made, the path switching member 31 is moved to the solid line position shown in FIG. 1 and the copy sheet from the fixing device 28 is guided to the inverting path 33. The Copy sheet is then transported to the intermediate tray 35 through the first path 36 and is placed temporarily therein with the face bearing the image faced upward. Thereafter, the copy sheet is fed at a specified timing from the intermediate tray 35 by the feed roller 43 and is transported along the second path 37 to the imaging assembly P. In the imaging assembly P, a document image is transferred to the other face of the copy sheet through the above-described operation, and consequently the copy sheet is discharged onto the discharge tray 30.

Figure 2:
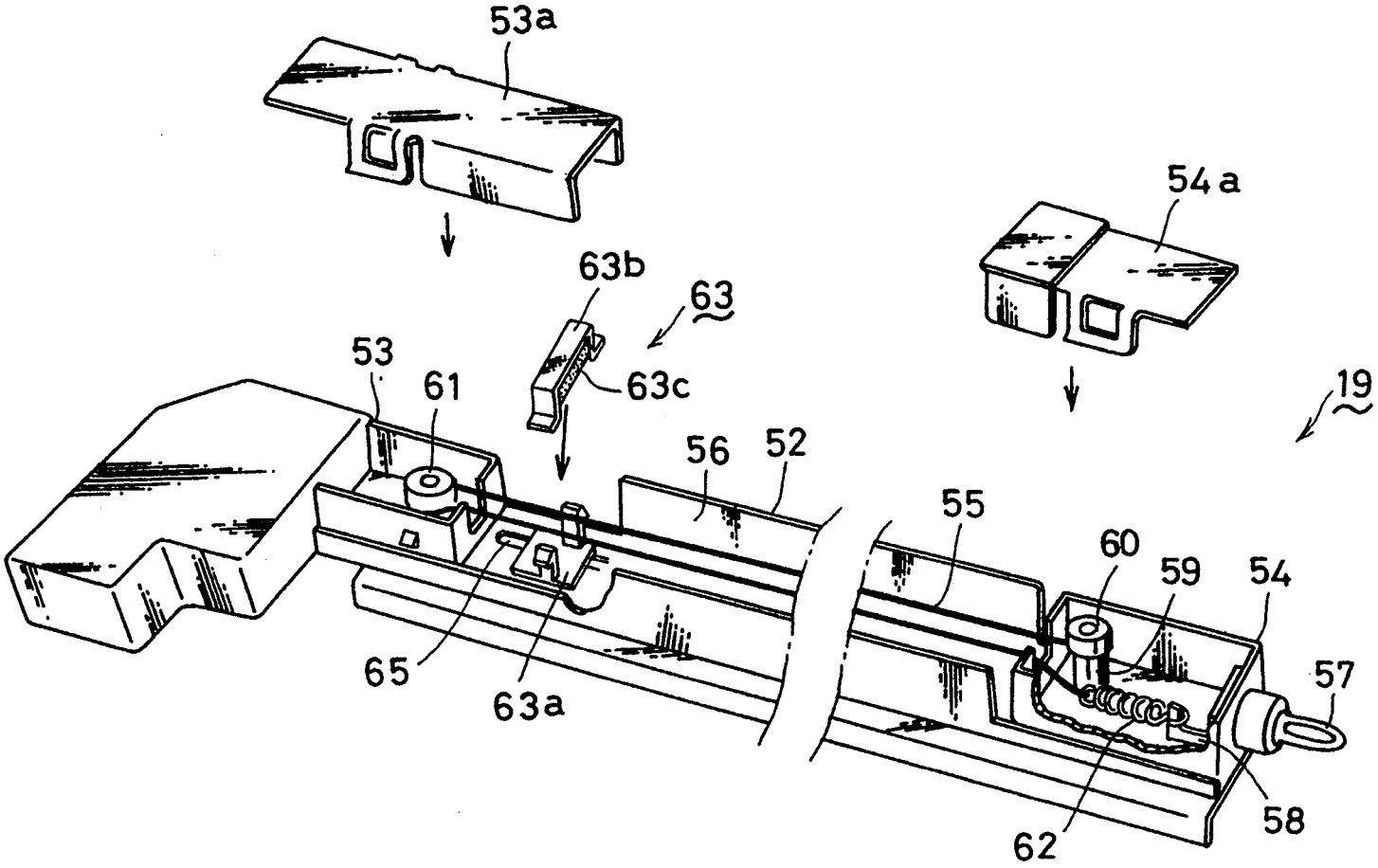
FIG. 2 is a perspective view showing a charger incorporated in the image forming apparatus.
Figure 3:
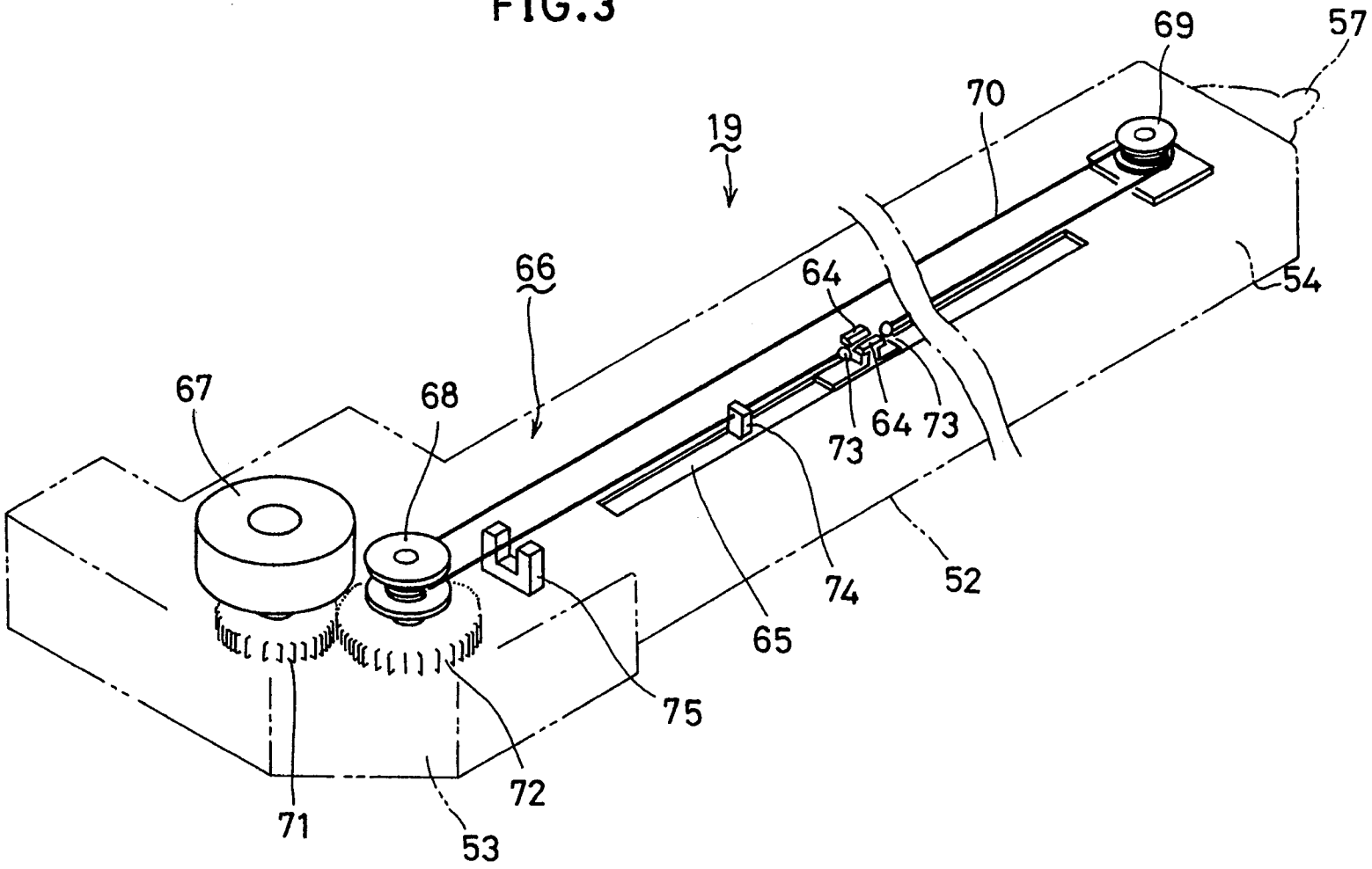
FIG. 3 is a diagram showing the charger in FIG. 2.

The construction of the charger 19 will be described with reference to FIGS. 2 and 3. FIG. 2 is a perspective view showing an exemplary charger incorporated in the copying machine according to the invention, and FIG. 3 is a diagram showing a drive device of a cleaning mechanism when viewed from a direction of arrow B in FIG. 2.

As shown in FIG. 2, the charger 19 includes a shield case 52, a charging wire 55 as a corona discharge electrode, and a cleaning mechanism for cleaning the charging wire 55.

The shield case 52 is a long member formed by bending a stainless plate so as to have a U-shaped cross-section and an opening 56 through which electric charges are discharged. Front and rear housings 53, 54 are respective fitted to opposite longitudinal ends of the shield case 52. At a rear end face of the rear housing 54 is provided a banana clip 57, which is spirally fitted through a rear end wall of the housing 54 to a terminal block provided inside the housing 54. When the charger 19 is mounted in the copying machine 1, the banana clip 57 is coupled with an unillustrated high voltage power supply.

In the shield case 52, the charging wire 55 such as a tungsten wire is stretched in the longitudinal direction of the shield case 52 between the front and rear housings 53, 54. Specifically, as shown in FIG. 2, the charging wire 55 has one end thereof inserted in a hollow rib 59 of the rear housing 54. This end of the wire 55 is tightly held by inserting a fixing pin 60 into the hollow rib 59. The wire 55 is pulled toward the front housing 53, is turned at a rib 61 of the front housing 53, and is then stretched toward the rear housing 54. In this way, two wires are stretched between the front and rear housings 53, 54. This is designed to improve the charging efficiency of the charger 19 to the photosensitive drum 18. The other end of the charging wire 55 is connected with one end hook of a tension spring 62 and the other end hook thereof is connected with a hook portion formed at the terminal block 58. Consequently, the charging wire 55 is stretched at a specified tension in the shield case 52 and a voltage from the high voltage power supply is applied to the charging wire 55 through the banana clip 57, the terminal block 58, and the tension spring 62. Front and rear covers **53*a*, 54*a* are respectively attached to upper portions of the front and rear housings 53, 54**.

There is also provided, in the shield case 52, a movable cleaning member 63 constituting the cleaning mechanism for cleaning off stains such as toner and paper powders attached to the stretched charging wire 55. The cleaning member 63 includes a movable frame **63*a*, a cover 63*b*, and a cleaning pad 63*c* as shown in FIG. 2. The cover 63*b* is attached to an upper portion of the movable frame 63*a* in such a manner as to hold the charging wire 55 therebetween. The cleaning pad 63*c* is adhered to a lower face of the cover 63*b* and is slidably in contact with the charging wire 55 to clean off the stains attached to the wire 55. As shown in FIGS. 2 and 3, the moving frame 63*a* is mounted such that a pair of leg portions 64, 64 formed at a bottom face thereof so as to project downward are fitted in a longitudinally extending guide groove 65 formed in a bottom wall of the shield case 52 and project downward from the bottom face of the shield case 52**.

The cleaning member 63 is driven by a drive device 66 provided at the bottom face of the shield case 52 so as to move reciprocally along the guide groove 65.

As shown in FIG. 3, the drive device 66 is provided in the front housing 53 and is driven controllably by the controller. The drive device 66 includes a drive motor 67 such as a stepper motor, front and rear pulleys 68, 69 provided respectively at the front and rear housings 53, 54, and an endless rotatable wire 70 which is stretched between the pulleys 68 and 69 after winding around these pulleys a specified number of times. The drive motor 67 is driven and a rotational force thereof is transmitted to the front pulley 68 through gears 71, 72 so that the wire 70 rotates reciprocally. Fixing members 73, 73 are fixed at suitable positions of the wire 70 spaced apart by a desired distance. The leg portions 64. 64 of the movable frame **63*a* hold tightly the wire 70 between the fixing members 73, 73, thus the cleaning member 63 is movable reciprocally in the shield case 52 in association with reciprocal rotation of the wire 70**.

Further, a detection piece 74 is provided on the rotatable wire 70 and a movement reference sensor 75 for detecting the detection piece 74 is provided in the vicinity of the front pulley 68. With the detection piece 74 and the sensor 75, a movement reference point (movement reference position) of the cleaning member 63 is detected.

The charger 19 thus constructed is mounted in the copying machine 1 from the rear housing 54 in such a manner that the opening 56 faces the surface of the photosensitive drum 18. When the charging wire 55 is cleaned while discharging electric charges upon the receipt of a specified voltage from the unillustrated high voltage power supply, the drive motor 67 is driven by the unillustrated controller and the rotatable wire 70 is rotated. According to the reciprocal rotation of the wire 70, the cleaning member 63 moves reciprocally in contact with the charging wire 55 while cleaning off stains adhered to the wire 55 such as toner and paper powders.

Figure 4:
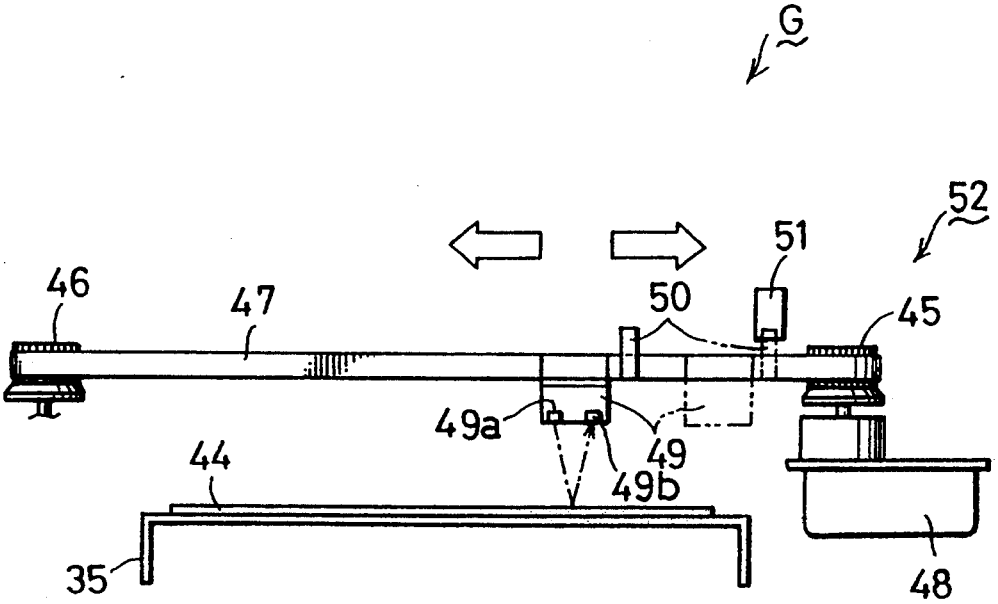
FIG. 4 is a diagram showing an exemplary white line detector incorporated in the image forming apparatus in FIG. 1.

The white line detector G will be next described with reference to FIG. 4. FIG. 4 is a diagram showing an exemplary white line detector G incorporated in the image forming apparatus according to the invention when viewed from a direction of arrow A in FIG. 1.

The white line detector G includes a white line sensor 49 for detecting a white line in an image on a copy sheet 44 contained in the intermediate tray 35 and a drive device 52 for moving the white line sensor 49 in a main scanning direction (a widthwise direction) of the copy sheet 4.

The drive device 52 includes front and rear pulleys 45, 46 provided at opposite sides of the intermediate tray 35, an endless timing belt 47 mounted between the pulleys 45, 46, and a drive motor 48 such as a stepper motor for drivingly rotating the front pulley 45. The drive motor 48 is driven reciprocally to thereby rotate the timing belt 47 reciprocally. The white line sensor 49 is fixed at a specified position of the timing belt 47 and is movable back and forth in the widthwise direction of the copy sheet 44 according to the reciprocal rotation of the timing belt 47. The sensor 49 is, for example, a reflection type photosensor including a light emitting element 49a and a photodetector 49*b* which are faced downward so as to detect the white line in the image on the copy sheet 44 contained in the intermediate tray 35. A detection piece 50 is provided at a specified position of the timing belt 47 and a detection reference sensor 51 is provided in the vicinity of the front pulley 45 so as to detect the detection piece 50. With the detection piece 50 and the sensor 51, a movement reference point (detection reference position) of the white line sensor 49 is detected.

The pulleys 45, 46 are spaced apart from an upper face of the intermediate tray 35 by a specified distance lest the white line sensor 49 should come to contact with copy sheets stacked up on the intermediate tray 35 when a normal mode is set.

In the white line detector G thus constructed, when the drive motor 48 is driven by an unillustrated controller, the timing belt 47 is rotated through the front pulley 45. According to the rotation of the belt 47, the white line sensor 49 moves forward to detect the presence or absence of the white line in the main scanning direction of the copy sheet 44 on the intermediate tray 35. After the detecting operation, the sensor 49 moves backward to the reference position. Here, it will be noted that the forward and backward directions refer to directions away from and toward the detection reference position respectively.

Figure 5:
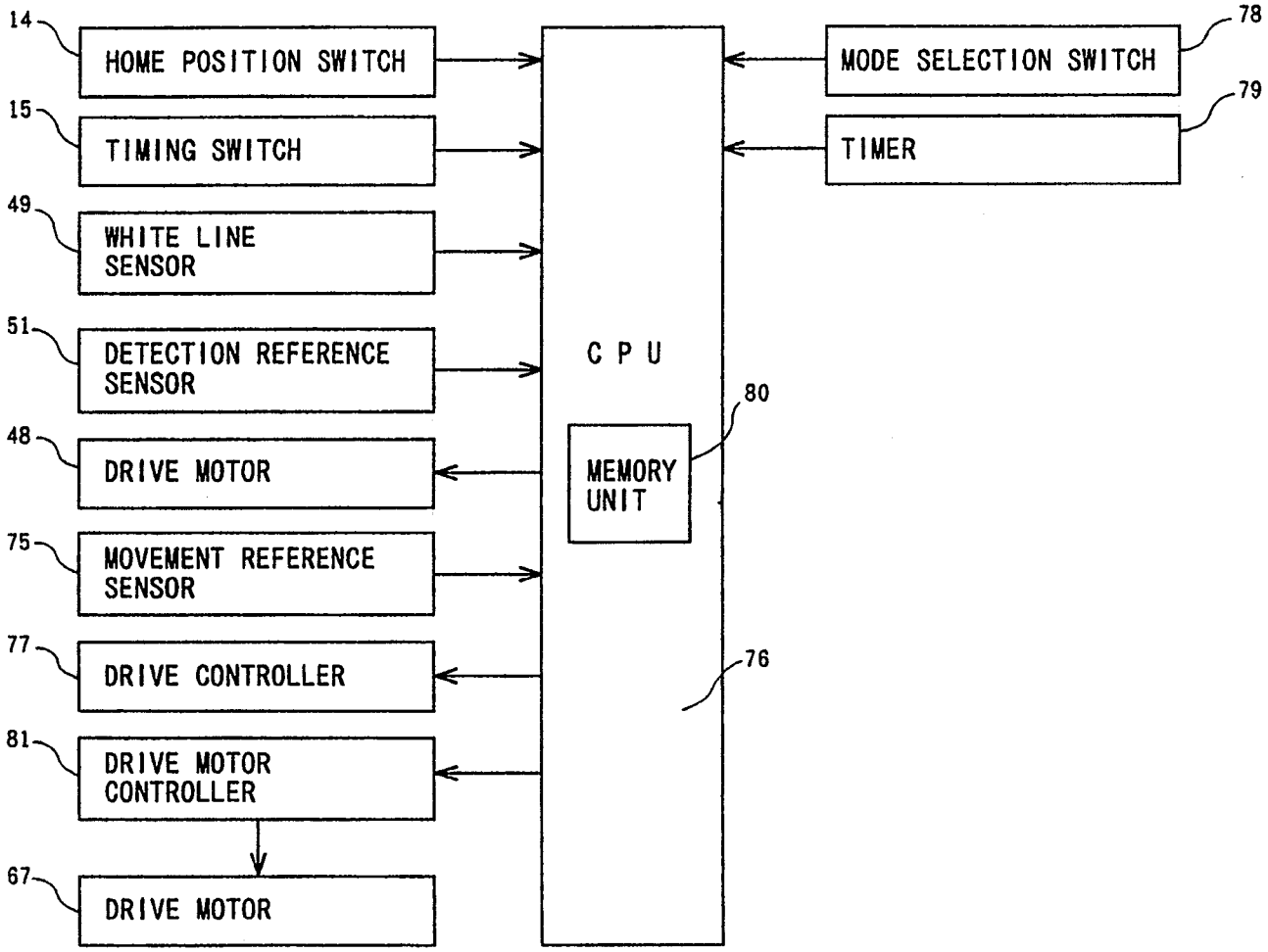
FIG. 5 is a block construction diagram showing a control system for conducting a charging wire cleaning operation in the image forming apparatus.

There will be described a control system for cleaning the charging wire 55 next with reference to FIG. 5.

Indicated at 76 is a central processing unit (hereinafter referred to as a CPU) for controlling centrally an operation of the copying machine 1. For example, the CPU 76 sends a control signal to a drive controller 77 to change an operation mode from a normal copy mode to a charger cleaning mode according to the operation of a mode selection switch 78 on an unillustrated operation panel provided at a suitable position on the upper surface of a main body of the copying machine 1. The CPU 76 also calculates a distance from the detection reference position to a portion corresponding to the white line found in the image on the copy sheet in accordance with the detection data from the white line sensor 49 and calculates an amount by which the cleaning member 63 is to be moved (hereinafter referred to as a moving amount). The calculated distance value is stored in a memory unit 80 provided in the CPU 76. The home position switch 14 sends a detection signal to the CPU 76 when the first and second optical systems 11, 12 are set at the initial positions. The timing switch 15 is turned on by the movement of the first optical system 11 and sends its detection signal to the CPU 76. A timer 79 starts measuring time in accordance with a control signal from the CPU 76 which is sent upon the receipt of the detection signal from the timing switch 15. The timer 79 is used to measure a timing at which the first optical system 11 reaches a stop position The stop position of the first optical system 11 refers to a position by which it is capable of reading all the image on the reference document member 17.

When the timer 79 measures the timing at which the first optical system 11 reaches the stop position, the CPU 76 sends a control signal to the drive controller 77 so as to stop the first and second optical systems 11, 12 and causes the path switching member 31 to move to the position where the copy sheet is allowed to be transported to the intermediate tray 35. In other words, in the charger cleaning mode, the CPU 76 controls an exposure timing so that an image of the reference document member 17 transferred to the copy sheet fed from the cassette 24 or the intermediate tray 35 is opposed to the white line detector G on the intermediate tray 35.

When the first and second optical systems 11, 12 are stopped, the copy sheet is fed and the image of the reference document member 17 is transferred thereto. Consequently, the copy sheet is contained in the intermediate tray 35.

When the copy sheet is contained in the intermediate tray 35, the drive motor 48 is driven to move the white line sensor 49 forward so as to detect the presence or absence of the white line with respect to the main scanning direction of the copy sheet. Upon the receipt of a detection signal from the detection reference sensor 51 for detecting the detection reference position of the sensor 49. i.e., the movement reference position thereof, the CPU 76 starts counting the number of pulses fed to the drive motor 48. In this way, there is detected a moved-amount of the sensor 49 from the detection reference position in the main scanning direction.

Upon the detection of the white line, the sensor 49 sends a detection signal to the CPU 76. The CPU 76 in turn calculates the distance from the detection reference position to a position where the white line is detected based on the pulse number fed to the drive motor 48 corresponding to this white line detection signal and further calculates a moving amount of the cleaning member 63 to the stained portion of the charging wire 55. Upon the completion of the white line detection, the CPU 76 allows a drive motor controller to control the drive motor 67 to move the cleaning member 63 to the stained portion. At this time, the movement reference position of the cleaning member 63 is detected by the movement reference sensor 75. Immediately before or when the cleaning member 63 is moved by the calculated moving amount, the CPU 76 sends a control signal to the drive motor controller 81 to move the cleaning member 63 reciprocally in a preset pattern so as to clean off the stains adhered to the charging wire 55.

Figure 6A:
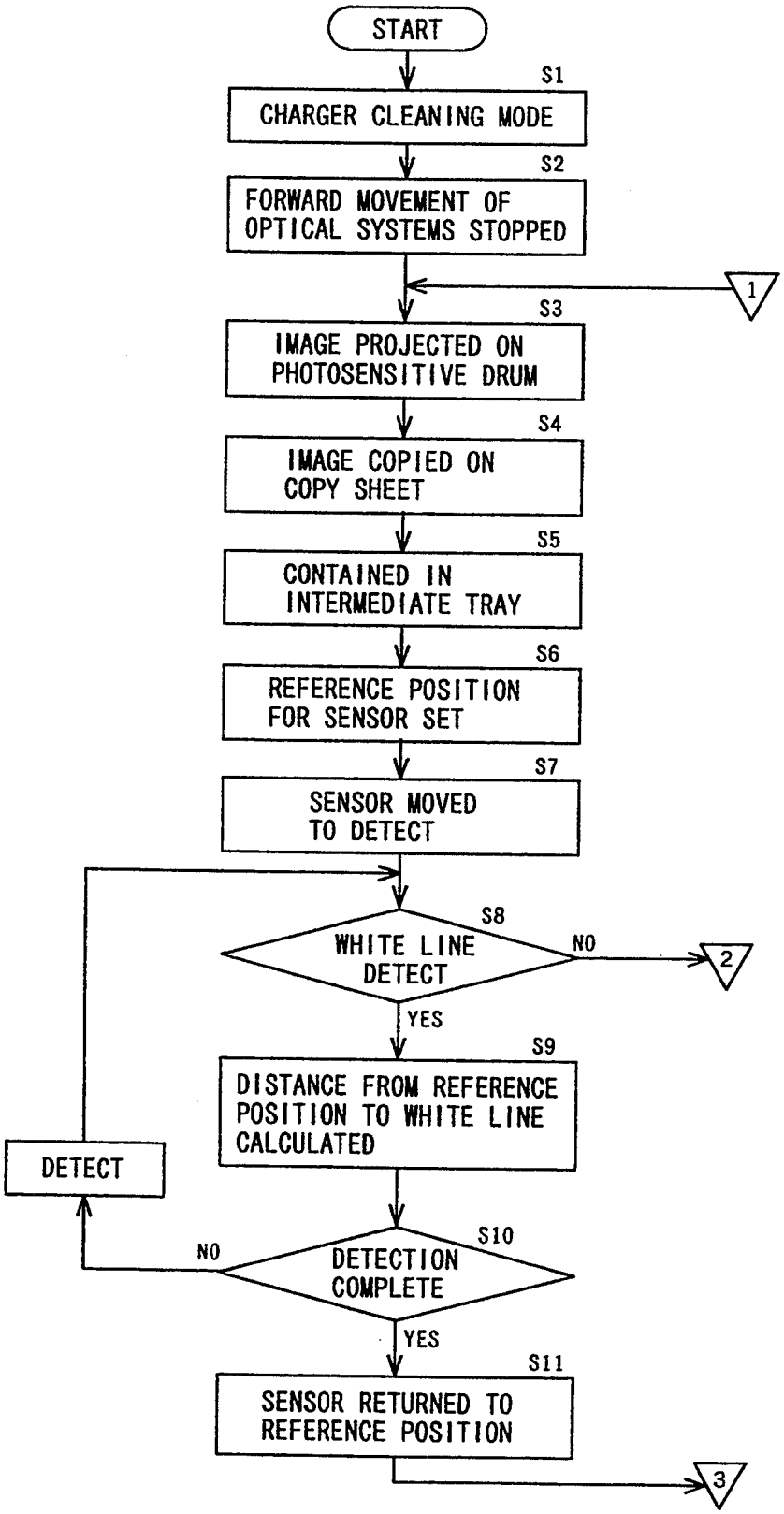
FIGS. 6A and 6B are a flow chart showing an exemplary operation of the image forming apparatus.
Figure 6B:
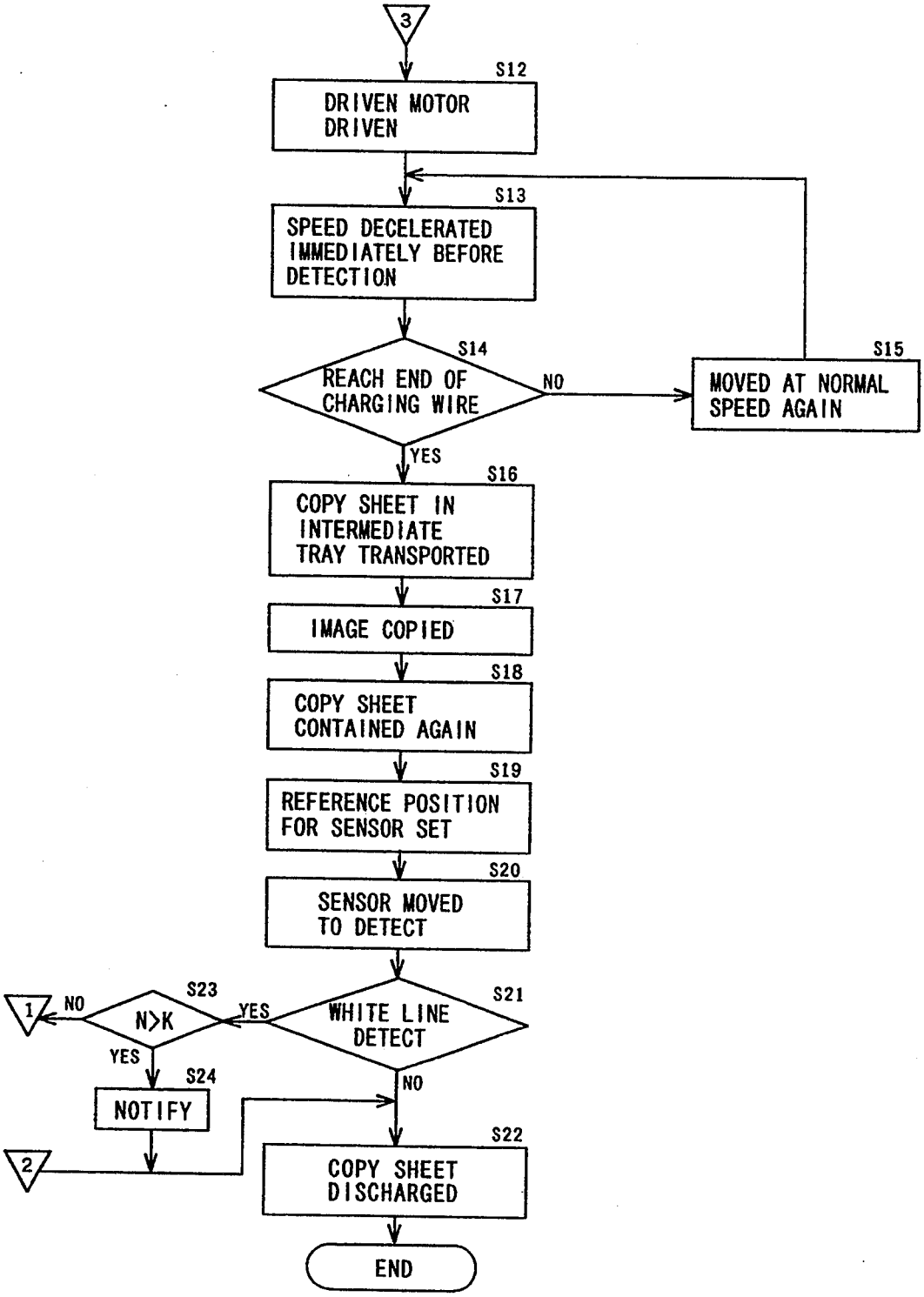

There will be described an operation of the image forming apparatus according to the invention next with reference to a flow chart shown in FIGS. 6A and 6B.

The first and second optical systems 11, 12 move forward from the initial positions when the mode selection switch 78 is operated and the charger cleaning mode is selected to clean the charging wire 55 of the charger 15 in Step S1. The forward movement of the first and second optical systems 11, 12 is stopped (Step S2) when the timer 79 measures the preset period following the detection of the first optical system 11 by the timing switch 15, and the image of the reference document member 17 is projected onto the surface of the photosensitive drum 18 (Step S3). Subsequently, the image of the reference document member 17 is copied on a copy sheet of a specified size, e.g., of the maximum size (Step S4), and this copy sheet is contained in the intermediate tray 35 (Step S5). When the document image is copied on the copy sheet, the halogen lamp 4 is turned off. However, the first and second optical systems 11, 12 are kept at positions where their movement is stopped.

The drive motor 48 is driven to move the white line sensor G when the copy sheet is contained in the intermediate tray 35. The detection reference sensor 51 detects the sensor 49 and sends the detection signal to the CPU 76, and thereby the detection reference position for the sensor 49 is set (Step S6). Thereupon, the CPU 76 starts counting the number of pulses fed to the drive motor 48 and the sensor 49 moves forward to detect the presence or absence of the white line (Step S7).

The white line sensor 49 carries out the white line detection entirely in the main scanning direction of the copy sheet contained in the intermediate tray 35 (Step S8). If no white line is detected (NO in Step S8), i.e. the charging wire 55 is not stained at all, this routine proceeds to Step S22 in which the copy sheet contained in the intermediate tray 35 is discharged onto the discharge tray 30 and the first and second optical systems 11, 12 are returned to the initial positions. Consequently, this routine ends and the copying machine 1 is brought into the normal copy mode. It may be appropriate to return the white line sensor 49 to the reference position at this time.

On the other hand, if the white line is detected, i.e. the charging wire 55 is stained (YES in Step S8), this routine proceeds to Step S9. In Step S9, a distance from the detection reference position to the portion corresponding to the detected white line is calculated based on a count value of the pulses fed to the drive motor 48 when the white line sensor 49 outputs the white line detection signal, and the calculated value is stored in the memory unit 80 of the CPU 76. In the case where a plurality of white lines are detected, the distance between the detection reference position and the portions corresponding to each white line is calculated and accordingly a plurality of calculated values are stored. When the sensor 49 completes the detection up to the end of the copy sheet in the main scanning direction (YES in Step S10), the drive motor 48 is driven in the reverse direction to return the sensor 49 to the reference position (Step S11).

Thereafter, the drive motor 67 is driven and thereby the cleaning member 63 starts sliding from the movement reference position along the charging wire 55 (Step S12). Simultaneously, the CPU 76 reads the calculated value from the memory unit 80 and causes the rotating speed of the drive motor 75 to decelerate for a period corresponding to a preset number of pulses so as to decelerate the speed of the cleaning member 63 immediately before the cleaning member 63 reaches the stained portion of the charging wire 55, i.e., a portion of the charging wire 55 corresponding to the portion on the copy sheet where the white line is detected (Step S13). In this way, the frictional force of the cleaning pad **63*c* with the charging wire 55 is increased so that the cleaning pad 63*c* cleans off the stains adhered to the charging wire 55 reliably. Upon the lapse of the preset number of pulses, the moving member 63 starts moving at the normal speed again (Step S15). When the moving member 63 reaches the end of the charging wire 55 (YES in Step S14), this routine proceeds to Step S16. Subsequently, the copy sheet contained in the intermediate tray 35 is transported again to the imaging assembly P (Step S16); has the image of the reference document member 17 copied on the other face thereof (Step S17); and is again contained in the intermediate tray 35 (Step S18). The detection reference position of the white line sensor 49 is set again (Step S19), and the presence or absence of the white line on the copied image detected (Step S20). At this time, the sensor 49 carries out the detection at the portion where the white line is previously detected based on the calculated distance to the white line detected portion which is stored in the memory unit 80 of the CPU 76. This routine proceeds to Step S22 and ends when no white line is detected (NO in Step S21), while returning to Step S3 when the white line is detected again (YES in Step S21). In Step S3, a new copy sheet is fed from the cassette 24. The previous copy sheet contained the intermediate tray 35 may be kept in the intermediate tray 35** or may be discharged.

When the white line is detected neither in Step S8 nor in Step S21, the copy sheet contained in the intermediate tray 35 is discharged onto the discharge tray 30 in Step S22, and thereby this routine ends and the copying machine is brought into the normal copy mode. In the case where the white line is detected constantly despite a preset number K of white line detection and cleaning of the charging wire 55 conducted according to this routine (YES in Step S21), that is, in the case where the number N of white line detections in Step S21 is judged to be over the predetermined number K (YES in Step S23); such an information of the white line being left or the charging wire 55 not being cleaned will be notified to an operator by means of, for example, an unillustrated warning means provided on the operation panel (Step S24).

As described above, the image forming apparatus according to the invention is capable of not only cleaning the charging wire 55 without removing the charger 19 therefrom but also cleaning the stained position efficiently.

Figure 7:
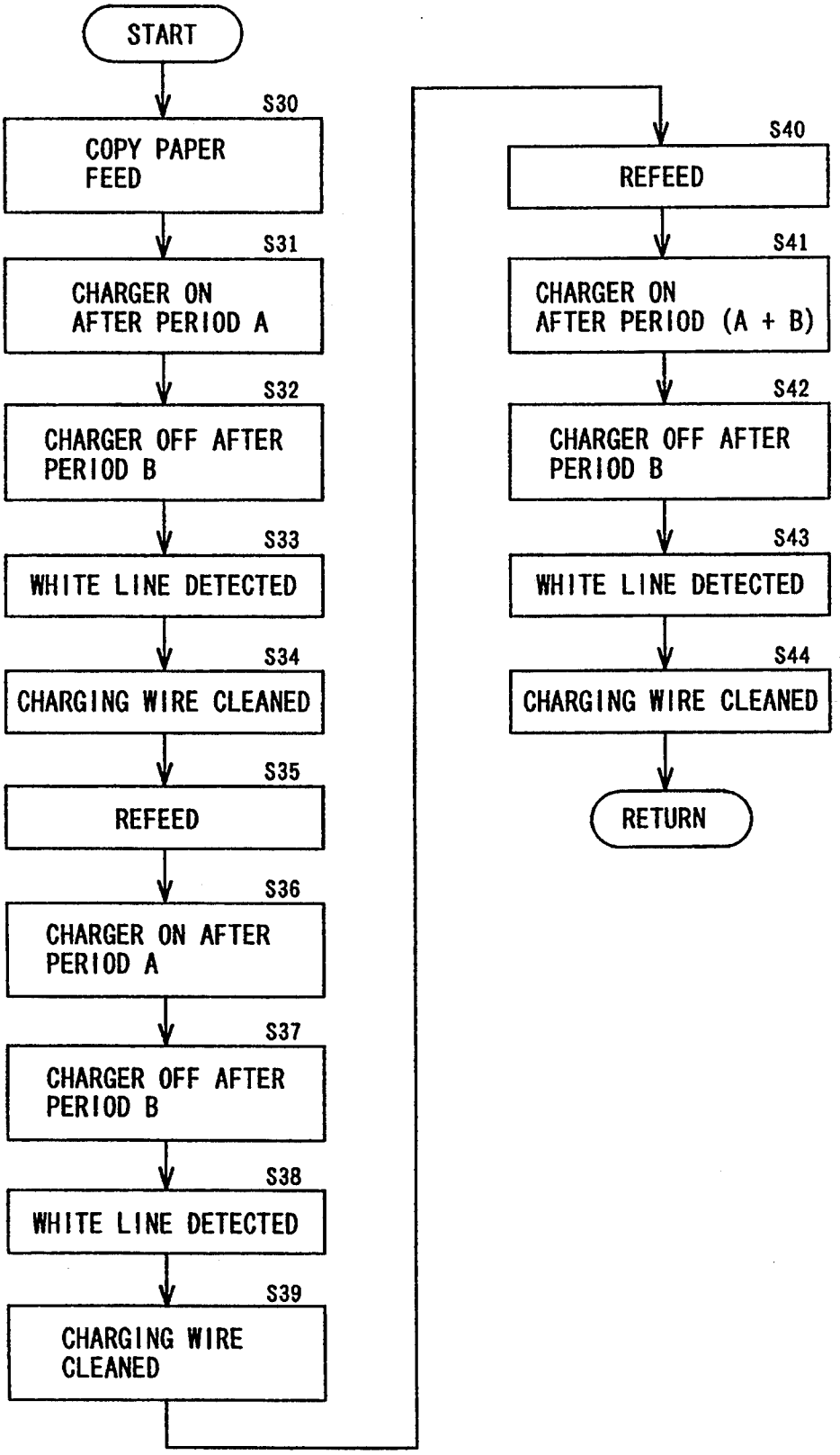
FIG. 7 is a flow chart showing another exemplary operation of the image forming apparatus.

In the foregoing embodiment, the white line sensor 49 moves along only one line in the main scanning direction of the copy sheet to detect the presence or absence of the white line. However, the sensor 49 may be constructed movable also in the sub-scanning direction, so that the white line is detected along a plurality of lines in the main scanning direction. For instance, there may be provided a pair of guide rails extending in the sub-scanning direction and spaced apart substantially. The sensor 49 may be moved reciprocally along these guide rails by means of a drive means such as a motor. In this case, the image forming apparatus may operate as shown in a flow chart of FIG. 7.

After the feed of the copy sheet is started in the charger cleaning mode (Step S30), the charger 19 starts discharging electric charges upon the lapse of a predetermined period (period A) following the turning-on of the registration switch 26*a* (Step S31). Then, in Step S32, the charger 19 stops discharging upon the further lapse of another predetermined period (period B) following the period A. In this way, the image of the reference document member 17 is copied in a suitable position with respect to the sub-scanning direction of one face (front face) of the copy sheet. Thereafter, the copy sheet is contained in the intermediate tray 35 and the white line is detected by the white line detector G (Step S33). Upon the detection of the white line, the cleaning member 63 is moved in the same manner as described above so as to clean the charging wire 55 (Step S34). Upon the completion of the cleaning of the charging wire 55, the copy sheet in the intermediate tray 35 is refed to the imaging assembly P (Step S35). The charger 19 starts discharging electric charges upon the lapse of the period A following the turning-on of the registration switch 26*a* (Step S36) and stops discharging upon the further lapse of the period B (Step S37). Consequently, the image of the reference document member 17 after the charging wire 55 is cleaned is copied on the other face of the copy sheet. In Step S38, it is detected whether there exists any white line in the copied image. Upon the detection of the white line, the charging wire 55 is cleaned using the cleaning member 63 (Step S39).

Thereafter, the copy sheet in the intermediate tray 35 is refed to the imaging assembly P (Step S40), and the image of the reference document member 17 is copied on the front face of the copy sheet. This time, the charger 19 starts discharging upon the lapse of a period (A+B) following the turning-on of the registration switch 26*a* (Step S41) and stops discharging upon the further lapse of the period B (Step S42). In other words, the image of the reference document member 17 is copied so that it is positioned adjacent to the first copied image with respect to the subscanning direction. This copy sheet is contained in the intermediate tray 35 and the white line is detected by the white line detector G (Step S43). However, since the image is copied at a position of the copy sheet displaced from the previously copied image in this case, the white sensor 49 is moved in the sub-scanning direction by a distance corresponding to the period (A+B) so as to face the newly copied image. Upon the detection of the white line, the charging wire 55 is cleaned in the same manner as described above (Step S44). As long as the white line is detected, i.e., the stains remain on the charging wire 55, the copy sheet is refed repeatedly to the imaging assembly P. A new image is copied next to the previously copied image and the white line sensor 49 is moved in the sub-scanning direction to a position corresponding to the new image.

The image forming apparatus thus constructed provides the same effect as the foregoing embodiment in cleaning the charger 19 and has an additional advantage that the white line is detected and confirmed a plurality of times using a single copy sheet.

In the foregoing embodiments, the moving speed of the cleaning member 63 is decelerated to clean off the stains adhered to the charging wire 55 when the white line is detected. However, for example, the cleaning member may be constructed so as to move over the stained portion back and forth a plurality of times. It may be suitably set how the cleaning member 63 cleans the charging wire 55, so that the cleaning is carried out effectively according to the stained state of the charging wire 55.

The copy machine 1 of the foregoing embodiments is designed to detect the stained portion on the charging wire 55 by detecting the white line in the image copied on the copy sheet and to clean off the stain at the detected portion with the cleaning member 63. In this copy machine 1, it is also possible to detect the image density simultaneously with the detection of the white line. The detected image density may be used to adjust a charging amount, a light adjustment plate, and a value of a bias voltage applied to a developing roller.

In the foregoing embodiments, the white line sensor 49 is constructed movable in the main scanning direction of the copy sheet. However, the white line sensor 49 may instead include a line sensor. The use of the line sensor obviates the need for the mechanism for moving the sensor 49, thereby enabling the detection of the white line with a simple construction.

Further, in the foregoing embodiment, the charging wire 55 is cleaned in response to the operation of the mode selection switch 78. However, the cleaning operation may be carried out regularly in synchronism with the turning-on of the main switch according to the number of copying operations conducted, passage of time, or the line.

As described above, according to the invention, a white line is detected in an image of a reference document member copied on a copy sheet so as to detect a stained portion of a charging wire and a cleaning device carries out a specified cleaning operation at the detected stained portion. This realizes efficient cleaning and removal of stains such as toner and paper powders adhered to the charging wire. Thus, the appearance of the undesirable white line on the copied image can be coped with rapidly and reliably.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. An image forming apparatus comprising:

an image forming unit for forming a copied image on copy paper, the image forming unit including:

a photosensitive body;

a charger for charging the photosensitive body, the charger having a charging wire extending in a lengthwise direction of the photosensitive body:

an optical system for illuminating a document and introducing a reflected light to the photosensitive body to produce a latent image of the document;

a developer for developing the latent image to a toner image; and a transfer for transferring the toner image onto the copy paper to form the copied image;

sensor means for detecting a white line on the copied image;

calculator means responsive to the sensor means for calculating a target portion of the charging wire; and cleaning means for cleaning the target portion, the cleaning means including:

a cleaning member movable along the charging wire for cleaning the charging wire;

driver means for moving the cleaning member along the charging wire;

controller means responsive to the calculator means for controlling the driver means to render the cleaning member to clean the target portion of the charging wire.

2. An image forming apparatus as defined in claim 1 wherein the cleaning member controller means controls the driver means to move the cleaning member back-and-forth within a specified range including the target portion.

3. An image forming apparatus as defined in claim 1 wherein the cleaning member controller means controls the driver means to move the cleaning member at a decreased speed within a specified range including the target portion.

4. An image forming apparatus as defined in claim 1 further comprising a document placing portion on which a document is to be placed, wherein the optical system is capable of selectively scanning either the document placing portion or a portion outside the document placing portion, and the sensor means includes a reference document member provided on an appropriate position of the portion outside the document placing portion, and optical system controller means for controlling the optical system to scan the reference document member when detecting the target portion.

5. An image forming apparatus as defined in claim 1 further comprising copy paper refeeding means for temporarily storing copy paper carrying a copied image on one side thereof and refeeding the copy paper to the photosensitive body to copy another image on the other side, wherein the sensor means includes a sensor for detecting a white line on a copied image, the sensor being provided on the copy paper refeeding means.

6. An image forming apparatus as defined in claim 5 further comprising refeeding controller means for controlling the refeeding means to store copy paper carrying a copied image on one side thereof to allow the sensor to detect a white line on the copied image on the one side to detect a target portion, and convey the copy paper to the photosensitive body after cleaning the target portion, if the target portion is detected, and to again store the copy paper carrying another copied image on the other side thereof to allow the sensor to detect a white line on the copied image on the other side to detect a target portion.

7. An image forming apparatus as defined in claim 6 wherein the sensor means further includes sensor driving means for driving the sensor, memory means for storing the target portion detected by the sensor on said one side, and sensor driving controller means for controlling the sensor driving means to position the sensor on the target portion stored in the memory means when detecting a white line on the copied image on said other side.

8. An image forming apparatus as defined in claim 1 further comprising:

memory means for storing the calculated target portion;

confirming means for confirming whether the target portion has been cleaned, the confirming means including:

judging means for judging whether the cleaning operation is finished;

resuming means responsive to the judging means for resuming an image forming operation of the image forming unit to produce another copied image after the cleaning operation is judged to be finished;

checking means responsive to the memory means for checking whether there is a white line on said another copied image at a portion corresponding to the target portion.

9. An image forming apparatus as defined in claim 1 wherein the cleaning means is responsive to the confirming means to clean the target portion again when the target portion is confirmed as not having been cleaned.

10. An image forming apparatus as defined in claim 9 further comprising notifying means for notifying the operator that the target portion has not been cleaned after a cleaning operation is executed a predetermined number of times.

11. An image forming apparatus comprising:

a photosensitive body;

charger means for charging the photosensitive body, the charger means including a charging wire extending in a lengthwise direction of the photosensitive body;

an optical system for illuminating a document and introducing a reflected light to the photosensitive body to produce a latent image of the document;

developing means for developing the latent image to a toner image;

transferring means for transferring the toner image onto copy paper;

detector means for detecting a target portion of the charging wire causing a white line based on a copied image on copy paper;

a cleaning member movable along the charging wire and adapted for cleaning the charging wire;

driver means for moving the cleaning member along the charging wire; and cleaning member controller means responsive to the detector means for controlling the driver means to move the cleaning member at a decreased speed, within a specified range including the target portion, to the target portion of the charging wire and clean the target portion.

12. An image forming apparatus comprising:

a photosensitive body;

charger means for charging the photosensitive body, the charger means including a charging wire extending in a lengthwise direction of the photosensitive body;

an optical system for illuminating a document and introducing a reflected light to the photosensitive body to produce a latent image of the document;

developing means for developing the latent image to a toner image;

transferring means for transferring the toner image onto copy paper;

detector means for detecting a target portion of the charging wire causing a white line based on a copied image on copy paper;

a cleaning member movable along the charging wire and adapted for cleaning the charging wire;

driver means for moving the cleaning member along the charging wire;

cleaning member controller means responsive to the detector means for controlling the driver means to move the cleaning member to the target portion of the charging wire and clean the target portion;

copy paper refeeding means for temporarily storing copy paper carrying a copied image on one side thereof and refeeding the copy paper to the photosensitive body to copy another image on the other side;

the detector means including a sensor for detecting a white line on a copied image, the sensor being provided on the copy paper refeeding means;

refeeding controller means for controlling the refeeding means to store copy paper carrying a copied image on one side thereof to allow the sensor to detect a white line on the copied image on the one side to detect a target portion, and convey the copy paper to the photosensitive body after cleaning the target portion, if the target portion is detected, and to again store the copy paper carrying another copied image on the other side thereof to allow the sensor to detect a white line on the copied image on the other side to detect a target portion.

* * * * *